US005562045A

United States Patent [19]

Rudibaugh et al.

[11] Patent Number: 5,562,045

[45] Date of Patent: Oct. 8, 1996

[54] BEARING ADAPTER AND ADAPTER PAD FOR RAILWAY TRUCKS

[75] Inventors: John W. Rudibaugh, West Chester; Charles L. Van Auken, Dillsburg, both of Pa.

[73] Assignee: Pennsy Corporation, Westchester, Pa.

[21] Appl. No.: 417,087

[22] Filed: Apr. 5, 1995

[51] Int. Cl.[6] ..... B61F 15/00

[52] U.S. Cl. ..... 105/224.1; 105/220

[58] Field of Search ..... 105/218.1, 220, 105/224.1, 225

[56] References Cited

U.S. PATENT DOCUMENTS

| | | | |
|---|---|---|---|
| 3,381,629 | 5/1968 | Jones | 105/218.1 |
| 3,699,897 | 10/1972 | Sherrick | 105/218.1 |
| 3,785,298 | 1/1974 | Reynolds | 105/218.1 |
| 5,009,521 | 4/1991 | Wiebe | 384/191 |
| 5,081,935 | 1/1992 | Pavlick | 105/218.1 |
| 5,237,933 | 8/1993 | Bucksbee | 105/224.1 |
| 5,404,826 | 4/1995 | Rudibaugh et al. | 105/224.1 |

*Primary Examiner*—Mark T. Le
*Attorney, Agent, or Firm*—Banner & Allegretti, Ltd.

[57] ABSTRACT

In a railway car truck assembly, a bearing adapter assembly includes an adapter and an adapter pad positioned between the adapter and a corresponding side frame end. The adapter is provided at each longitudinal end thereof an adapter opening having a lateral dimension greater than the lateral width of a corresponding thrust lug in a corresponding pedestal opening at the corresponding side frame end. The adapter pad is provided with longitudinal end portions depending down into respective ones of the adapter openings and including thrust lug openings each having with a lateral dimension approximately equal to the lateral width of the corresponding thrust lug to prevent significant relative lateral movement between the corresponding side frame end and the adapter pad.

25 Claims, 4 Drawing Sheets

Fig.3
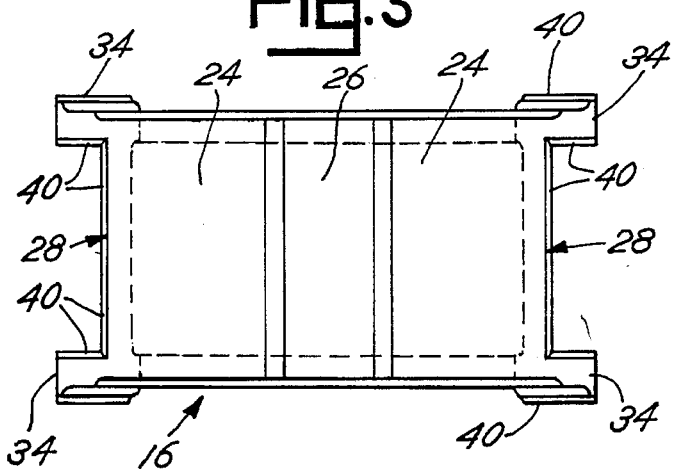
Fig.4
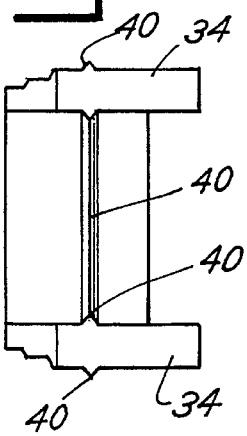
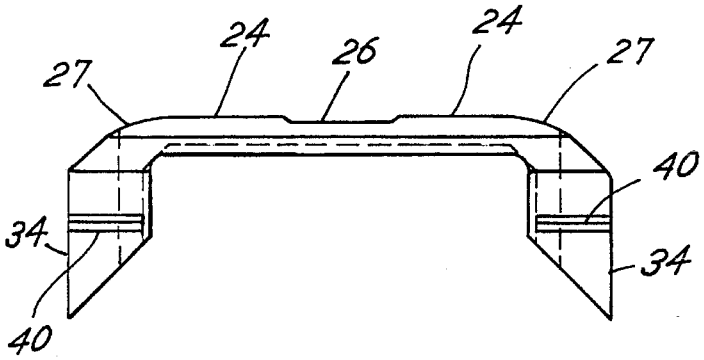
Fig.5

Fig.6
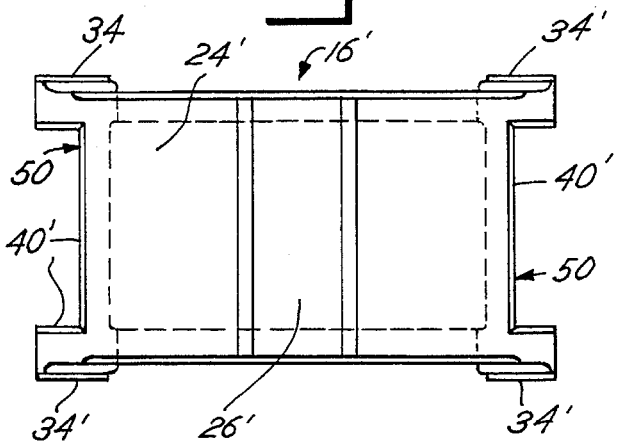
Fig.7
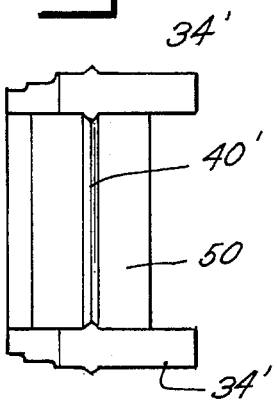
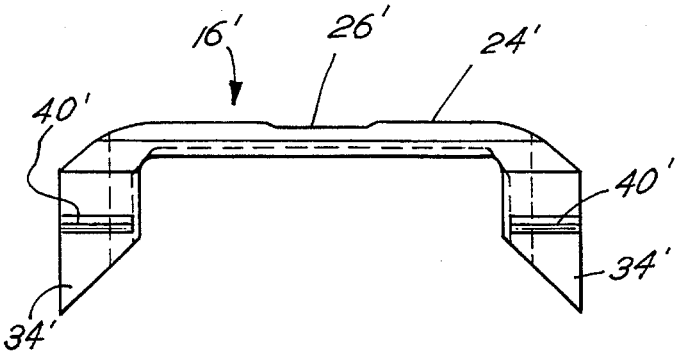
Fig.8
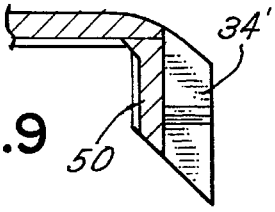
Fig.9
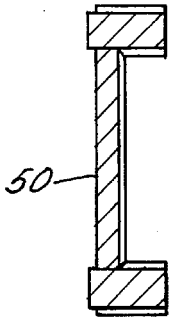
Fig.10

BEARING ADAPTER AND ADAPTER PAD FOR RAILWAY TRUCKS

BACKGROUND OF THE INVENTION

The present invention relates to a freight car truck, and in particular to a side frame pedestal area where the axle and bearing are journaled to the side frame.

Application Ser. No. 08/084,286, filed Jun. 28, 1993, now U.S. Pat. No. 5,404,926 and assigned to the assignee of the present invention, discloses a special type of bearing adapter which is designed to permit lateral movement between each axle and the corresponding side frames. FIG. 1 of the foregoing patent application shows a truck assembly 10 including a pair of axles 12 and 14, a pair of side frames 16 and 18, four wheels 20, 22, 24 and 26, and a bolster 28 which extends laterally between the side frames with its opposed ends projecting into openings in the side frames so as to be supported on spring assemblies shown at 30. The truck assembly 10 further includes four bearings 32, each having an adapter assembly 34 disposed between the bearing and the underside of a pedestal portion 36 of the side frame.

Still referring to the above-identified patent application, FIG. 2 shows one of the pedestal portions 36 of the side frame, each side frame having one such pedestal portion 36 at each end thereof to receive in the pedestal opening a bearing 32. The adapter 34 and related components are disposed between the top of the bearing 32 and the underside of the pedestal roof, the latter being shown at 40 in FIGS. 4 and 5 in the prior application. FIGS. 4 and 5 further show a pair of side walls 42 and 44 which define a pedestal opening 46. In addition, on each of the side walls 42 and 44, near the upper ends thereof, a thrust lug 48 is formed.

As shown in the prior application in FIG. 3, the adapter 34 has depending end flanges 65 which extend down over a portion of the bearing 32 to prevent significant lateral or axial movement between the adapter 34 and the axle 12, the axle being fixed relative to the wheels. In accordance with the invention disclosed in the foregoing application, relative lateral or axial movement, left and right movement as shown in FIG. 3, is permitted between the adapter 34, axle 12 and wheels on the one hand, and the side frames 16 and 18. The uppermost structure in FIG. 3 comprises the pedestal portion 36 of the side frame 16, and about ¾ inch of lateral or axial movement between that side frame and the adapter 34 and related components is a feature of the invention of the pending application.

Reference is now made to FIG. 4 of the above-identified application for an explanation of the physical structure which permits and limits the magnitude of such relative lateral movement. FIG. 4 shows a portion of one of the opposed thrust lugs 48 formed near the top of the pedestal opening 46 on the side frame 16. The two thrust lugs 48 are best shown in FIG. 5. With reference to FIG. 4, when the components are assembled, the thrust lugs 48 fit down into openings 66 in each side of the adapter, such openings being defined by opposed shoulders 68 and 70.

In a conventional truck assembly, the width or axial dimension of the thrust lugs 48 is only slightly less than the width or axial dimension of the thrust lug opening 66 formed in the adapter as shown in FIG. 4, with the result that no meaningful relative lateral movement is permitted. In accordance with the invention disclosed in the aforesaid pending application, the width or axial dimension of the side frames 16 and 18 and thrust lugs 48 is not reduced, but is standard. Instead, the width or axial dimension of the thrust lug opening 66 in FIG. 4 has been increased by ¾ inch, making it a total of 4 and 13/16th inches. As a result, a total of approximately ¾ inch of relative lateral movement is permitted between the side frame 16 and the adapters 34. Further relative lateral movement is not permitted as the thrust lugs 48 on the side frame will engage the shoulders 68 and 70 which define the thrust lug opening 66 in each of the two sides of the adapter 34 as shown in FIG. 4.

By permitting up to approximately ¾ inch lateral movement between the wheel and axle assembly and the side frame, as taught by the above-identified patent application, it is possible to achieve improved ride conditions and to reduce truck hunting which is a swiveling action of the truck while running down the track. At the same time, such relative lateral movement of the truck components increases wear and can require replacement of worn parts. The present invention is intended for use on freight car trucks, as for example trucks used with coal cars, where the quality of the ride is not the primary factor. In such cases, it is desired to sacrifice to some extent the quality of the ride in order to minimize wear.

By substantially eliminating relative lateral movement between an adapter and the side frame, it is possible to significantly reduce wear between the parts. However, prior to the invention of the above-identified pending application, it was known to provide railway trucks which did not permit significant relative lateral movement between the side frame and the components mounted in the pedestal opening of the side frame. The present invention not only eliminates such relative lateral movement, but at the same time it provides important advantages not afforded by known arrangements. Indeed, it significantly reduces forces between the wheel flanges and the rails to improve the negotiation of curves in the track.

The present invention does not utilize a standard adapter. Instead, it utilizes an adapter of the type disclosed in the aforesaid pending application where the space between the shoulders shown at 68 and 70 in FIG. 4 is a total of approximately 4 and 13/16th inches, or approximately ¾ inch greater than standard, i.e., approximately ¾ inch greater than the lateral width of the conventional thrust lugs as shown as 48 in FIGS. 4 and 5 of the foregoing application. However, in accordance with the present invention, that increased space between the adapter shoulders is not utilized to achieve relative lateral movement, but instead is used to accommodate a special adapter pad which is positioned between the adapter and the side frame and eliminates metal-to-metal contact between those two components.

In accordance with the present invention, the adapter pad is non-metallic, and is preferably a polyurethane elastomer having a hardness in the range of 70A to 75D. Other materials such as rubber can be used, but a castable polyurethane or castable polymer is preferred. Of course, any railcar truck utilizing adapters of the type described in the aforesaid application, having about ¾ inch extra space between the shoulders 68 and 70 of the adapter, may be converted for use in accordance with the present invention by adding an adapter pad as taught by the present invention. The addition of such an adapter pad will eliminate the relative lateral movement described in the prior application, it will reduce wear, and at the same time it will markedly improve the action between the wheels and the rail to achieve advantages not afforded by the invention of the prior application.

The foregoing and other objectings and advantages of the invention will be apparent from the following description of certain preferred embodiments thereof, taken in conjunction with the accompanying drawings.

DESCRIPTION OF THE DRAWINGS

FIG. 3 is a top plan view of the adapter pad;

FIG. 4 is an end view of the adapter pad;

FIG. 5 is a vertical elevation view of the adapter pad;

FIG. 6 is a top plan view of an alternative embodiment of an adapter pad where the outer end walls of the pad are made of a softer material than the remainder of the pad;

FIG. 7 is an end view of the adapter pad of FIG. 6;

FIG. 8 is a vertical elevational view of the adapter pad of FIG. 6;

FIG. 9 is a fragmentary section taken along the line B—B of FIG. 6;

FIG. 10 is a section taken along the line A—A of FIG. 8;

Now, in order to acquaint those skilled in the art with the manner of making and using our invention, we shall describe, in conjunction with the accompanying drawings, certain preferred embodiments of the invention.

DETAILED DESCRIPTION OF THE INVENTION

Figure 1:
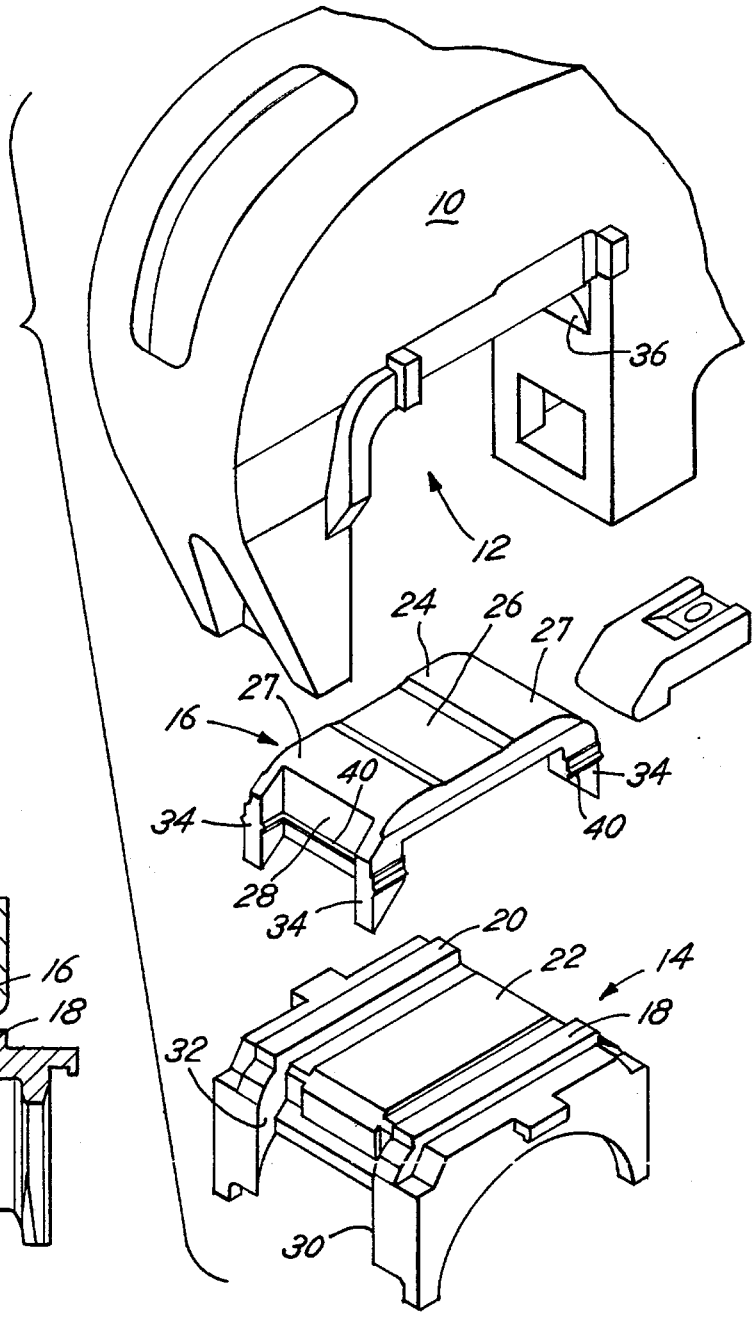
FIG. 1 is an exploded perspective view showing the pedestal portion of a side frame, an adapter, and a non-metallic adapter pad for positioning between the adapter and the side frame pedestal portion.

FIG. 1 shows a pedestal portion 10 of a side frame, each side frame having one such pedestal portion at each end thereof to define a pedestal opening 12 to receive an adapter 14. In accordance with the present invention, non-metallic adapter pad 16 sits on top of the adapter 14 and fits beneath the pedestal roof to eliminate metal-to-metal contact between the adapter 14 and the pedestal 10.

Figure 2:
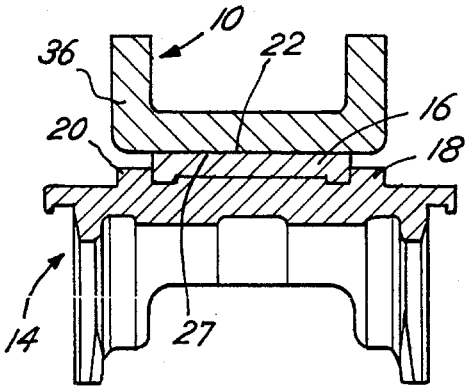
FIG. 2 is a vertical sectional view showing an adapter pad positioned between a side frame pedestal roof and an adapter.

As shown in FIG. 1, the adapter 14 has a pair of upwardly projecting parallel rails 18 and 20 which extend longitudinally. The rails 18 and 20 are spaced to permit the pad 16 to be positioned between then and retained against significant lateral movement relative to the adapter 14. FIG. 2 shows how the adapter pad 16 fits on the top 22 of the adapter and is positioned between the rails 18 and 20.

The adapter pad 16 has a top surface 24 which is flat, except for a depressed, flat central portion 26, and except near the two longitudinal ends 27 when it curves slightly as it joins with vertical end walls as shown at 28. The prior art teaches the use of adapters having depressed central areas resembling the area 26, but that has been done to provide a wear indicator. Use of such known adapters will cause wear on the roof 27 of the pedestal opening 12 which leaves a depending or protruding central area. Thus, the purpose of the depressed area 26 on the top of adapter pad 16 is not to provide a wear indicator, but rather to provide some space to accommodate a protruding central area expected to be found on the pedestal roof of a used side frame. In order words, the shape of the top of the adapter pad 16 is designed to fit closely with the expected shape of the pedestal roof 27 of a used side frame. In any event, the major portion of the top surface 24 of the non-metallic adapter pad 16 is flat and will be loaded uniformly against the pedestal roof of a side frame pedestal as shown at 27 in FIG. 2.

The adapter 14 has shoulders 30 and 32 which as described earlier herein are spaced apart 4 and 13/16 inch, such shoulders being provided at each longitudinal end of the adapter. The adapter pad 16 has four projecting legs 34, one at each of its four corners, and each pair of those legs 34 is spaced to fit closely within the space between the adapter shoulders 30 and 32. As a result, when the adapter pad 16 is positioned down onto the top 22 of adapter 14, the projecting legs 34 are positioned against respective adapter shoulders 30 and 32, and the body of the adapter pad fits between the guide rails 18 and 20, so as to prevent relative lateral movement between the adapter pad 16 and the adapter 14. In addition, the depending longitudinal ends of the adapter pad 16 fit down over the longitudinal end walls of the adapter 14 between the shoulders 30 and 32 to prevent relative longitudinal movement between the adapter pad 16 and the adapter 14.

As previously explained, the above-identified prior application showed an adapter where the shoulders 30 and 32 defined a thrust lug opening to receive a corresponding thrust lug such as shown at 36 in FIG. 1 of the present application, there being one such thrust lug at each longitudinal end of the pedestal opening 12. However, in accordance with the present invention, the four adapter pad projecting legs 34 fit into the opening between the shoulders 30 and 32, with the result that those projecting legs 34 are what define thrust lug openings.

In the present case, the intent is to eliminate lateral movement between the side frame, and the adapter and adapter pad assembly. Accordingly, the space between each pair of projecting adapter pad legs 34 is determined so as to closely receive a corresponding thrust lug 36 therebetween. Because each such thrust lug 36 will fit closely between each corresponding pair of pad legs 34, and because the adapter pad is prevented from lateral movement relative to adapter 14, there will be no significant lateral movement between the adapter 14 and the side frame pedestal 10. Similarly, the adapter pad 16 is held against longitudinal movement relative to adapter 14, and the vertical end walls 28 of the adapter pad 16 will fit closely against the thrust lugs 36, so there will be no significant longitudinal movement between the adapter 14 and the side frame pedestal 10.

An important feature of the present invention concerns a series of ridges 40 formed on the adapter pad 16 as shown in FIGS. 1 and 3–5. As described above, the adapter pad 16 is made of a non-metallic material, to be described more fully hereinafter, and it is compressible. The ridges 40 are triangular in cross-sectional configuration, and they project about 1/16th inch from the walls of the pad. Preferably, such ridges should project from 1/8th to 1/32nd inch from the supporting pad wall.

As shown in the drawings, each longitudinal end of the pad has a ridge 40 extending horizontally across end wall 28, as well as along the insides of legs 34, so that the thrust lug pocket defined at each end of pad 16 is in effect lined by a ridge 40 on three sides. Thus, engagement between the pad 16 and the thrust lugs 36 is cushioned by the ridges 40 which line the thrust lug pockets in the pad. In addition, a horizontal ridge 40 extends along the outside of each adapter pad leg 34 so engagement between those legs and the adapter shoulders 30 and 32 is also cushioned by ridges 40.

The surfaces on the adapter pad 16 which have the projecting ridges 40 are designed to have a line-to-line fit with the mating thrust lugs and mating surfaces of the adapter 14. Of course, tolerances in manufacturing exist, but the projecting ridges 40 assure there will be an interference or press fit between all such making surfaces. Such tightness of the fitting parts reduces any relative movement and reduces wear between the parts.

We will now describe the material for the adapter pad 16. The non-metallic pad is preferably made of a material having a hardness in the range of 70A on the soft end to 75D on the hard end. A more preferred range of hardness is 90A to 58D. One material which has been found to be ideally suited for the pad is Adiprene L 167 Polymer which has a hardness of 48D and is made by Uniroyal of Middleberry, CN. The pad 16 is cast, and it is preferred to use a castable polyurethane. Various castable polymers may be used, especially if they have a hardness within the foregoing ranges.

Reference is now made to FIGS. 6–10 which show an alternative embodiment of the pad 16, and corresponding primed numerals will be used to describe corresponding parts. The pad 16' is made by casting a hard urethane blank and then casting sections of soft urethane to the blank in a second casting step. Such a process is known in the art in the production of cast urethane parts. However, such a dual hardness adapter pad is believed to be novel.

Still referring to FIGS. 6–10, the soft part of the pad 16 which is cast in the second casting process comprises the longitudinally opposite outside end faces shown at 50. The remainder of the pad 16 is cast of a harder material in the first casting process. It is the outside ends 50 of the pad 16 which are relatively soft, and those vertical end surfaces of the adapter pad 16 are the surfaces which are in contact with the faces of the thrust lugs as shown at 36 in FIG. 1. When a railcar is going around a curve, the thrust lug 36 can turn relative to the adapter pad 16 by compressing against the softer surface 50. The result is that there is permitted some twisting or turning of the thrust lug 36 relative to the soft end surface 50 of the adapter pad 16.

Such relative movement facilities going around a curve, and as a result optimum wheel alignment is obtained in traversing a curve. However, at other times, as when traveling at high speed along straight track, the relative hardness of the remainder of the cast urethane pad 16' provides better truck squaring and thereby reduces truck hunting. The previously described projecting ridges are also preferably utilized in the embodiment of FIGS. 6–10 as shown at 40'.

With respect to the hardness of the adapter pad 16', one preferred embodiment is to have the area 50 to be relatively soft such as 70A hardness which in accordance with the earlier description is the soft end of the preferred range of 70A to 75D durometer. The remainder or relatively hard portion of the adapter pad 16' may be 75D which is the hard end of the previously described range. Of course, somewhat softer materials for the harder portion of the pedestal and somewhat harder materials for the softer portion of the pad will be suitable for particular applications.

Figure 11:
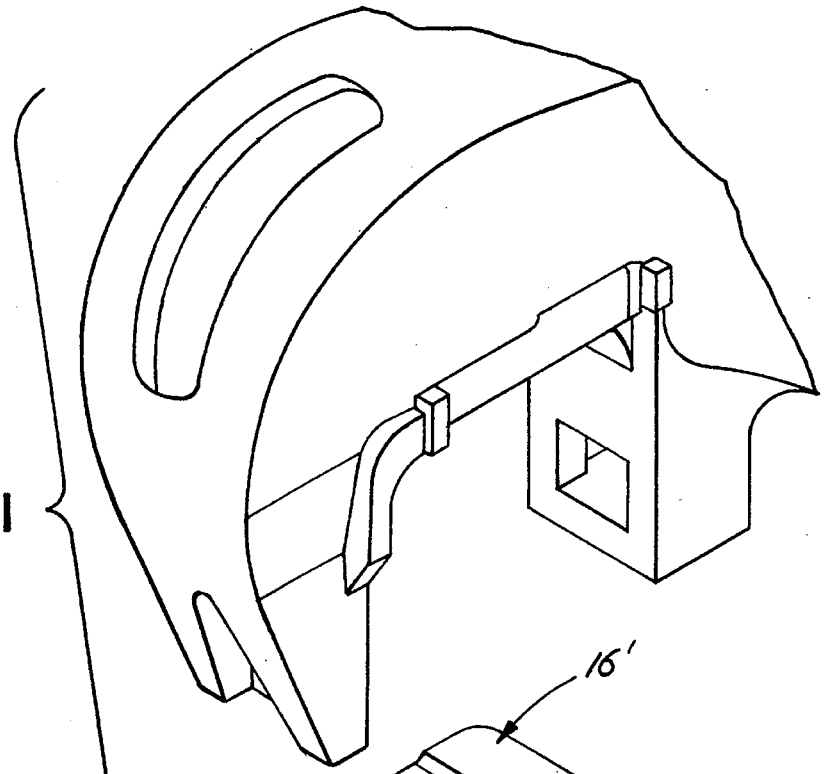
FIG. 11 is an exploded perspective view of another embodiment of the invention which includes special safety features to avoid problems in the event the non-metallic pad should become dislodged from its position between the adapter and the side frame pedestal roof.
Figure 13:
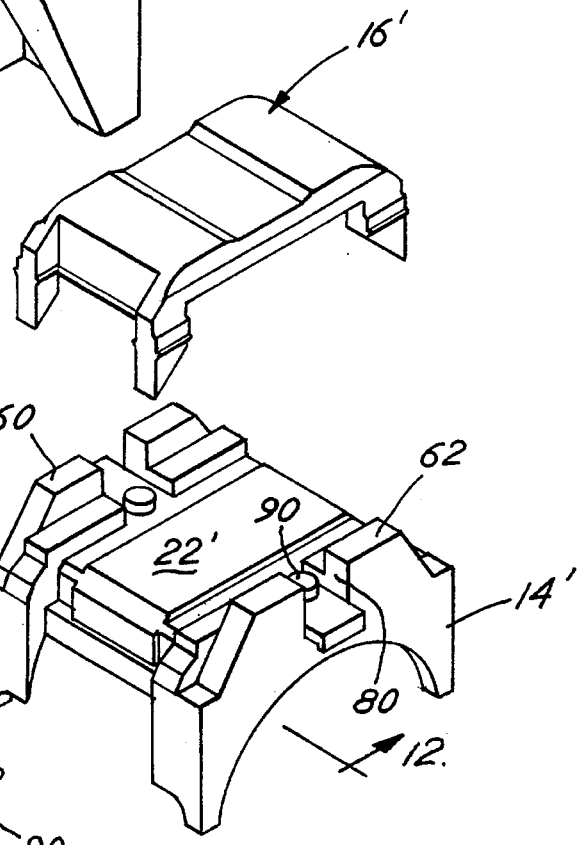
FIG. 13 is a section taken along the line B—B of FIG. 12.
Figure 12:
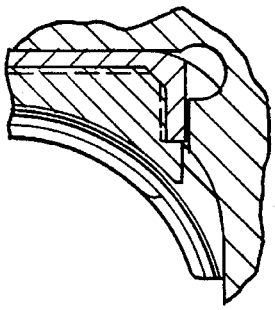
FIG. 12 is a section taken along the line A—A of FIG. 11 showing an adapter pad positioned between a side frame pedestal roof and an adapter.
Figure 12:
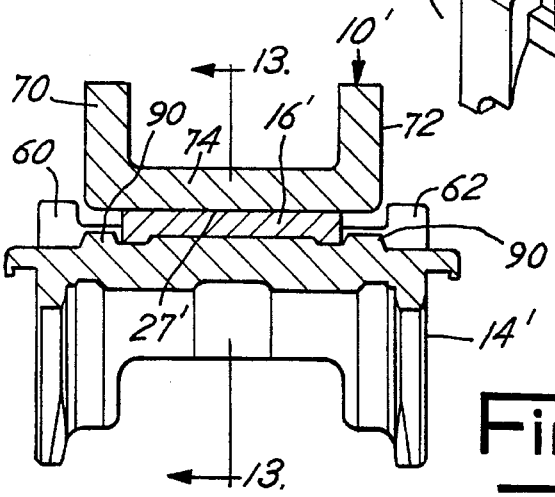

Reference is now made to FIGS. 11–13 which show an alternative embodiment with respect to the relationship between the adapter and the pedestal roof. The embodiment of FIGS. 11–13 is similar in many respects to the embodiment of FIGS. 1 and 2, and corresponding primed numerals will be used for corresponding parts. The adapter pad 16 of FIGS. 3–5 or the composite adapter pad 16' of FIGS. 6–10 may be used with the alternative embodiment of FIGS. 11–13.

The primary advantage of the embodiments of FIGS. 11–13 is that it provides important safety features in the event the adapter pad 16 should become dislodged from its position so it no longer separates the adapter 14 from the pedestal 10. Referring by way of example to FIG. 2, it will be seen that if the adapter pad 16 were not present, the adapter rails 18 and 20 would engage the underside 27 of the pedestal roof, and at that point lateral shifting between the side frame pedestal 10 and the adapter 14 could occur, limited only by adapter shoulders 30 and 32 which are spaced apart substantially greater than the width of the thrust lugs 36.

In order to avoid the foregoing in the event the pad 16 should disappear, FIGS. 11 and 12 show longitudinal rails 60 and 62 extending upwardly from the adapter 14'. As best shown in FIG. 12, the rails 60 and 62 are spaced apart outwardly of the side walls 70 and 72 which extend up from the pedestal roof 74, so if the adapter pad 16' were lost, the rails 60 and 62 would restrain the adapter 14' laterally relative to the pedestal roof 10' as the adapter 14' would come into contact with the pedestal roof 27' due to absence of the adapter pad 16'. Thus, the upwardly extending rails 60 and 62 on the adapter 14' serve as a backup structure for restraining relative lateral movement between the adapter 14' and the side frame pedestal 10' in the event the adapter pad 16' should be lost.

FIG. 11 shows a further safety feature incorporated into the adapter 14'. Each upwardly projecting rail 60 and 62 is provided with a window opening 80, and immediately inward of that window a wear button 90 is cast integrally into the adapter 14'. As can be seen from FIGS. 11 and 12, if the adapter pad 16' should disappear, the pedestal roof 27' will come into contact with the wear buttons 90 on the adapter 14', thereby preventing contact and wear on the top surface 22' of the adapter.

Thus, in the embodiment of FIGS. 11–13, if the adapter pad 16' disappears, the side frame will sit right down on the top 22' of the adapter 14' and the rails 60 and 62 will prevent lateral shifting between the side frame and the adapter. Also, an inspector can look into the window 80 at the side of the adapter 14' and determine whether the adapter pad 16' is in place. Also, if the pad 16' is not in place, the buttons 90 will take wear before the side frame will sit directly on top of the adapter 14', so an inspector can look through a window 80 and see if the button 90 is worn. In that manner, an inspector can determine not only whether the adapter pad 16' is missing, but if it is, the inspector can determine how long it has been missing and whether wear on the adapter top is imminent.

We claim:

1. In a railway car truck assembly including a wheel set, a pair of axles, a pair of side frames, and a truck bolster, each side frame having a pedestal opening at each end thereof, a pair of opposing thrust lugs located on side walls which define each said pedestal opening in positions proximate a top of said pedestal opening, and a bearing assembly on each end of each said axle positioned in a corresponding side frame pedestal opening for mounting each end of said side frames on the end of a corresponding axle, the improvement comprising, in combination, an adapter mounted in said pedestal opening on top of each said bearing assembly, said adapter having an opening at each longitudinal end thereof, each said opening being defined by a laterally extending adapter end wall and a pair of longitudinally extending laterally spaced adapter shoulders, said adapter shoulders being spaced greater than the lateral width of a corresponding thrust lug, a non-metallic adapter pad mounted on top of said adapter, each said adapter pad having a top which extends the longitudinal length of a top of said adapter and has longitudinal end portions which depend down into respective ones of said openings, said non-metallic adapter pad having a thrust lug opening at each longitudinal end thereof, said thrust lug opening being defined by a laterally extending adapter pad end wall and a pair of longitudinally extending laterally spaced adapter pad shoulders, said adapter pad shoulders being spaced approximately an amount equal to the lateral width of a corresponding thrust lug to prevent significant relative lateral movement between said side frame and said adapter pad.

2. The invention defined in claim 1 where said non-metallic adapter pad is cast from a material having a hardness in the range of 70A to 75D durometer.

3. The invention defined in claim 1 where said non-metallic adapter pad is cast from a material having a hardness in the range of 90A to 58D durometer.

4. The invention defined in claim 1 where said non-metallic adapter pad is cast from a polyurethane material.

5. The invention defined in claim 1 where said non-metallic adapter pad is cast from rubber.

6. The invention defined in claim 1 where said non-metallic adapter pad is cast from a polyurethane material having a hardness in the range of 70A to 75D durometer.

7. The invention defined in claim 1 where said non-metallic adapter pad is cast from a polyurethane material having a hardness in the range of 90A to 58D durometer.

8. The invention defined in claim 1 where said non-metallic adapter pad is cast from L 167 Polymer.

9. The invention defined in claim 1 where said non-metallic adapter pad is formed in two casting steps, the first step being to cast a relatively hard blank, and the second step being to cast sections of softer material to the blank.

10. The invention defined in claim 9 where said first step utilizes relatively hard polyurethane material and said second step utilizes relatively soft polyurethane material.

11. The invention defined in claim 9 where said second step comprises casting sections of relatively soft material at longitudinally opposite outside end faces of said adapter pad which end faces engage against the faces of respective ones of said thrust lugs.

12. The invention of defined in claim 11 where said first casting step utilizes polyurethane having a hardness of approximately 75D durometer and said second step utilizes polyurethane having a hardness of approximately 70A durometer.

13. The invention defined in claim 1 where said non-metallic adapter pad has a top portion, a pair of opposed generally vertical end walls at its longitudinally opposite ends, and four longitudinally projecting leg members, one at each corner, the inside surfaces of each laterally spaced pair of said leg members defining a respective one of said thrust lug openings.

14. The invention defined in claim 13 where said top portion of said non-metallic adapted pad is substantially flat.

15. The invention defined in claim 14 where said top portion includes a depressed central area.

16. The invention defined in claim 13 where a linear projecting ridge is formed horizontally along each of said vertical end walls for creating a press fit with the faces of said thrust lugs.

17. The invention defined in claim 16 where a horizontal linear projecting ridge is also formed along the insides of each of said laterally spaced pair of said leg members to create a press fit with the sides of said thrust lugs.

18. The invention defined in claim 17 where a horizontal linear projecting ridge is also formed along the outsides of each of said laterally spaced pair of leg members to create a press fit with the sides of said laterally spaced adapter shoulders.

19. The invention defined in claim 1 where said adapter is formed with a pair of longitudinally extending rails which project upwardly and are spaced apart laterally an amount sufficient so that if said adapter pad should become lost, said rails will encompass and laterally restrain the lateral walls of said pedestal.

20. The invention defined in claim 19 where at least one of said rails has a window formed therein, and also a wear member positioned immediately inside said window and cast integrally with said adapter, whereby an inspector can look in said window and determine wear on said wear member prior to any wear occurring on the top surface of said adapter.

21. In a railway car truck assembly including a wheel set, a pair of axles, a pair of side frames, and a truck bolster, each side frame having a pedestal opening at each end thereof, a pair of opposing thrust lugs located on side walls which define each said pedestal opening in positions proximate a top of said pedestal opening, and a bearing assembly on each end of each said axle positioned in a corresponding side frame pedestal opening for mounting each end of said side frames on the end of a corresponding axle, the improvement comprising, in combination, an adapter mounted in said pedestal opening on top of each said bearing assembly, said adapter having an opening at each longitudinal end thereof, each said opening being defined by a laterally extending adapter end wall and a pair of longitudinally extending laterally spaced adapter shoulders, said adapter shoulders being spaced greater than the lateral width of a corresponding thrust lug, a non-metallic adapter pad mounted on top of said adapter, each said adapter pad having a top which extends the longitudinal length of a top of said adapter and has longitudinal end portions which depend down into respective ones of said openings, said non-metallic adapter pad having a thrust lug opening at each longitudinal end thereof, said thrust lug opening being defined by a laterally extending adapter pad end wall and a pair of longitudinally extending laterally spaced adapter pad shoulders, said adapter pad shoulders being spaced approximately an amount equal to the lateral width of a corresponding thrust lug to prevent significant relative lateral movement between said side frame and said adapter pad, said non-metallic adapter pad having a top portion, a pair of opposed generally vertical end walls at its longitudinally opposite ends, and four longitudinally projecting leg members, one at each corner, the inside surfaces of each laterally spaced pair of said leg members defining a respective one of said thrust lug openings, said non-metallic adapter pad being made of a polyurethane material having a hardness in the range of 70A to 75D durometer.

22. The invention defined in claim 21 where said polyurethane adapter pad is formed in two casting steps, the first step being to cast a relatively hard blank, and the second step being to cast sections of softer material at longitudinally opposite outside end faces of said adapter pad which end faces engage against the faces of respective ones of said thrust lugs.

23. The invention defined in claim 21 where said polyurethane adapter pad is cast from a material having a hardness in the range of 90A to 58D durometer.

24. The invention defined in claim 20 where a linear projecting ridge is formed horizontally along each of said vertical end walls for creating a press fit with the faces of said thrust lugs, and a horizontal linear projecting ridge is also formed along the insides of each of said laterally spaced pair of said leg members to create a press fit with the sides of said thrust lugs.

25. The invention as defined in claim 24 where a horizontal linear projecting ridge is also formed along the outside of each of said laterally spaced pair of leg members to create a press fit with the sides of said laterally spaced adapter shoulders.

* * * * *